United States Patent [19]

Holzapfel

[11] 4,088,437

[45] May 9, 1978

[54] COMBUSTION CHAMBER

[75] Inventor: Immanuel Holzapfel, Stuttgart, Germany

[73] Assignee: Daimler-Benz Aktiengesellschaft, Germany

[21] Appl. No.: 721,218

[22] Filed: Sep. 8, 1976

[30] Foreign Application Priority Data

Sep. 25, 1975 Germany ..... 2542719

[51] Int. Cl.[2] ..... F23D 11/04

[52] U.S. Cl. ..... 431/161; 431/210; 431/242; 431/246; 431/247; 431/352

[58] Field of Search ..... 431/161, 162, 167, 242, 431/243, 245, 246, 247, 11, 210, 352, 353

[56] References Cited

U.S. PATENT DOCUMENTS

| | | | |
|---|---|---|---|
| 1,269,282 | 6/1918 | Howard | 431/242 |
| 3,986,815 | 10/1976 | Miyahara | 431/242 |

FOREIGN PATENT DOCUMENTS

| | | | |
|---|---|---|---|
| 199,780 | 9/1958 | Austria | 431/242 |
| 455,123 | 3/1949 | Canada | 431/242 |
| 659,286 | 10/1951 | United Kingdom | 431/245 |

*Primary Examiner*—Edward G. Favors
*Attorney, Agent, or Firm*—Craig & Antonelli

[57] ABSTRACT

A combustion chamber with an evaporator that projects into the combustion zone of the flame tube and includes a coaxial channel and to which air and fuel are supplied separately; a deflection surface is thereby arranged at the end of the evaporator channel which deflects the fuel/air mixture on all sides essentially opposite to the main flow direction prevailing in the channel; an annular channel partly surrounding the evaporator channel adjoins the deflection surface which is in communication by way of discharge openings with a mixing zone disposed upstream of the combustion zone, as viewed in the main flow direction; the mixing zone is formed by an annular space between an outer wall of the evaporator and an intermediate wall of the flame tube, in which are arranged radial webs within a first and a second plane, whereby the discharge openings of the annular channel terminate between the radial webs.

30 Claims, 6 Drawing Figures

COMBUSTION CHAMBER

The present invention relates to a combustion chamber with an evaporator projecting into the combustion zone of the flame tube, which contains a coaxial channel, to which air and fuel are fed separately and at end of which is arranged a deflection surface axially symmetrical with respect to the evaporator axis, which deflects the fuel/air mixture on all sides essentially opposite the main flow direction prevailing in the channel.

In a known combustion chamber of this type (German Offenlegungsschrift No. 2,340,013) a rich fuel/air mixture flows from the deflection surface of an evaporator directly into the combustion zone of the flame pipe. The mixture may thereby contain still unevaporated fuel which leads to a non-uniform distribution of fuel and air and to a corresponding incomplete combustion. The combustion gases therefore still contain carbon monoxide and partly combusted hydrocarbons. Additionally, nitrogen oxides are formed within zones having locally high temperatures which are unavoidable with the combustion of a non-homogeneous mixture.

The present invention is therefore concerned with the task to eliminate these shortcomings and to provide a combustion chamber with an evaporator, in which a uniform mixture from fuel vapor and air is formed, which produces over the entire operating range a combustion which is as complete as possible and as free of harmful substances as possible. This takes place according to the present invention in that an annular channel partly surrounding the evaporator channel adjoins the deflection surface, whose discharge directed radially outwardly approximately at right angle is connected by way of discharge apertures with a mixing zone disposed upstream of the combustion zone in the main flow direction, which mixing zone is being formed by an annular space traversed by air between an outer wall of the evaporator and an intermediate wall of the flame tube, in which radial webs are arranged in a first and in a second plane, between which terminate and discharge the apertures of the annular channel. Such a mixing zone provided with webs and directly cooperating with the evaporator, into which a mixture of completely evaporated fuel and air flows radially out of the annular channel of the evaporator, enables the feed of a high-grade homogeneous mixture to every place of the combustion zone. As a result thereof, such combustion temperatures can be maintained which are sufficiently high in order to produce a complete combustion of carbon monoxides (complete oxidation) and of partly combusted hydrocarbons, and which are nonetheless sufficiently low in order to far-reachingly prevent the formation of nitrogen oxides.

According to one advantageous embodiment of the present invention, the mixing zone terminates or discharges funnel-shaped into the combustion zone so that the walls delimiting the mixing zone and the outer annular channel are located essentially on cone surfaces. The flow direction in the combustion zone and therewith the progress of the combustion can be favorably influenced by the fuel/air mixture which flows inwardly directed out of the mixing zone.

According to the present invention, a throttle slide member may be arranged directly in front of the webs arranged in the first plane of the mixing zone.

Accordingly, it is an object of the present invention to provide a combustion chamber which avoids by simple means the aforementioned shortcomings and drawbacks encountered in the prior art.

Another object of the present invention resides in a combustion chamber with an evaporator, in which a uniform mixture is formed from fuel vapor and air, that produces as complete as possible a combustion over the entire operating range of the combustion chamber.

A further object of the present invention resides in a combustion chamber which assures a combustion free of harmful substances in the exhaust thereof.

Still another object of the present invention resides in a combustion chamber which produces a high-grade homogeneous mixture at every place of the combustion zone.

A further object of the present invention resides in a combustion chamber which permits the maintenance of such combustion temperatures or temperature ranges which are sufficiently high to assure complete oxidation of all carbon monoxides and complete combustion of hydrocarbons yet is sufficiently low to prevent the formation of nitrogen oxides.

Still a further object of the present invention resides in a combustion chamber which enables an optimization of the control of the fuel/air ratio for each operating point.

These and other objects, features and advantages of the present invention will become more apparent from the following description when taken in connection with the accompanying drawing which shows, for purposes of illustration only, several embodiments in accordance with the present invention, and wherein.

Figure 1:
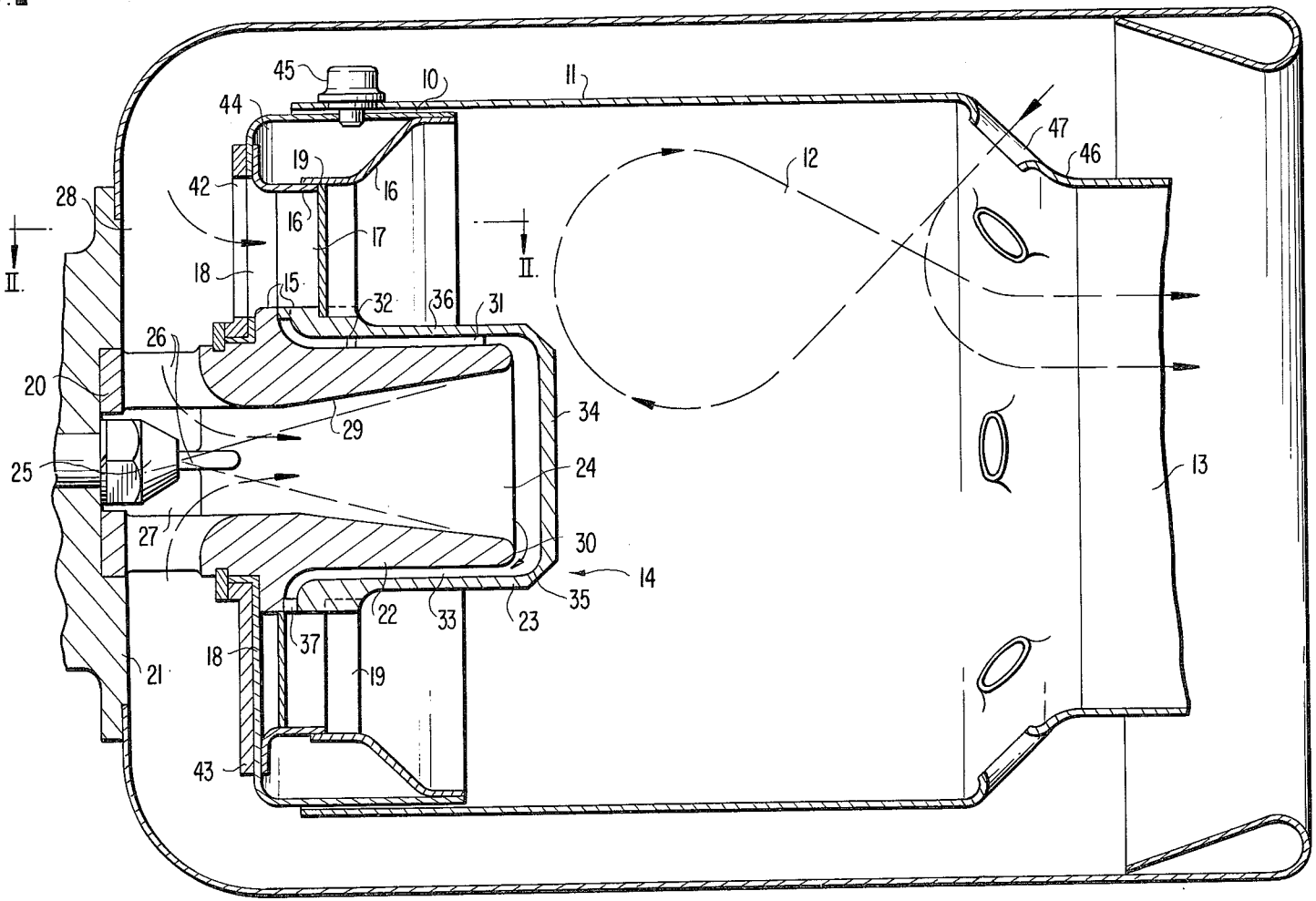
FIG. 1 is a longitudinal cross-sectional view through a first embodiment of a combustion chamber of a motor vehicle gas turbine in accordance with the present invention.

Referring now to the drawing wherein like reference numerals are used throughout the various views to designate like parts, and more particularly to FIG. 1, the combustion chamber illustrated in FIG. 1 comprises a flame tube 11 which includes a combustion zone 12, also referred to as primary zone, and a secondary zone 13. An evaporator generally designated by reference numeral 14 projects into the combustion zone 12, whose outer wall 15 forms together with an intermediate wall 16 of the flame tube 11 an annular space which serves as mixing zone 17. The evaporator 14 is connected by radial webs 18 and 19 with the intermediate wall 16 of the flame tube 11 and by a flange 20 with the end wall 21 of the combustion chamber.

The evaporator 14 consists of a cylindrically shaped evaporator body 22 and of an evaporator pot 23 arranged coaxially thereto. The evaporator 14 is closed off with respect to the combustion zone 12.

The evaporator body 22 includes a channel 24 coaxial to the evaporator 14, into the forward end of which projects an atomizing nozzle 25 for the fuel which extends through the end wall 21 of the combustion chamber and the flange 20. Webs 26 connected with the flange 20 leave open radial apertures 27 at the inlet of the channel 24 which serve for the supply of combustion air out of an annular space 28 between the end wall 21 of the combustion chamber and the space surrounded by the flame tube 11. The inner wall 29 of the channel 24 which starts from the webs 26 has the configuration of a Venturi nozzle. The end surface 30 of the evaporator member 22 at the outlet of the channel 24 is rounded off approximately semi-circularly shaped in cross section.

The evaporator pot 23 is so connected with the outer wall 32 of the evaporator body 22 by means of radial webs 31 that it surrounds the larger portion thereof with a spacing. As a result thereof, an annular channel 33 is formed which adjoins the channel 24 coaxially. The bottom 34 of the evaporator pot 23 is constructed as deflection surface for the flow. For that purpose, the edge 35 of the otherwise flat bottom 34 which is disposed at a distance opposite the rounded-off end surface 30 passes over into the cylindrical surface 36 of the evaporator pot 23 by means of an axially symmetrical curvature. The annular channel 33 is curved outwardly on all sides at its end and terminates in the mixing zone 17 by means of radial discharge apertures 37.

In the mixing zone 17, the webs 18 and 19 are arranged in two cross planes and are secured at the evaporator body 22 or at the surface 36 of the evaporator pot 23, on the one hand, and at the intermediate wall 16 of the flame tube 11, on the other. The webs 18 and 19 are constructed as plate-shaped hollow bodies or as U-profile and are arranged transversely to the flow direction. The webs 18 and 19 are rounded off at their sides 38 or legs 39 so that they form therebetween nozzle-shaped inlet openings 40 or discharge openings 41 in the two cross planes. The webs 18 and 19 and therewith also the inlet openings 40 and the discharge openings 41 are mutually offset. An opening 37 of the annular channel 33 terminates behind each web 18.

A disk-shaped throttle slide valve member 43 provided with openings 42 is rotatably supported on the evaporator body 22 directly in front of or upstream of the webs 18. The free cross-sectional area between the openings 42 and the inlet openings 40 of the webs 18, through which the air is adapted to flow, can be changed by rotation of the throttle slide valve member 43.

The intermediate wall 16 of the flame tube 11 consists of several parts which produce a ring-shaped hollow body 44. The hollow body 44 forms together with the webs 18 and 19 as well as with the evaporator body 22 and the evaporator pot 23 a structural unit which is so secured in the flame tube 11 in a readily interchangeable manner by means of centering pins 45 that an annular gap 10 results through which air is able to flow in for the internal cooling of the flame tube 11.

Within the area of the secondary zone 13, the flame tube 11 has a tapering or narrowing section 46. The section 46 which reduces the diametric dimension from the combustion zone 12 to the secondary zone 13, includes secondary air openings 47 which are inclined to the combustion zone in a direction opposite the main flow direction.

During the operation of the motor vehicle gas turbine, the combustion air supplied by a compressor (not shown) flows into the annular space 28. From there, the air flows for the larger part directly into the mixing zone 17 between the flame tube 11 and the evaporator 14 and for a lesser part into the mixing zone 17 by way of the channel 24 and the annular channel 33 of the evaporator 14 in which it absorbs fuel. The proportion of the air flowing into the channel 24 amounts, for example, to about 10% of the entire combustion air.

The fuel is injected into the channel 24 by the atomizer nozzle 25. A smaller portion of the fuel thereby mixes with the air whereas the larger portion is applied as film onto the bottom 34 of the evaporator pot 23, on which the fuel evaporates and diffuses into the air flowing over the same. The strong directional change of the flow within the area of the hottest place of the evaporator 14, i.e., of the bottom 34, increases the rate of evaporation and the speed of the diffusion of the fuel into the air. The evaporation and diffusion of the fuel continues during the flow through the adjoining annular channel 33 so that an essentially homogeneous mixture of fuel vapor and air flows into the mixing zone 17 through the radial openings 37.

The larger portion of the air which simultaneously flows out of the annular space 28 into the mixing zone 17 through the inlet openings 40 envelopes thereat the fuel/air mixture radially leaving out of the openings 37 arranged directly behind or downstream of the webs 18, which leads to a mixing of the two gas streams. Both the mutually offset of the webs 18 and 19 as also the nozzle-shaped configuration of the inlet openings 40 and of the discharge openings 41 contribute significantly to a thorough mixing of the gas streams so that the same are supplied as a homogeneous mixture to the combustion zone 12 of the flame tube 11, in which the fuel is being combusted.

The inner wall 29 of the channel 24 which is constructed as Venturi nozzle increases at the input thereof the flow velocity and contributes therewith to a better mixing of the fuel with the air. The pressure increase at the outlet of the enlarged channel 24 enhances the flow through the adjoining annular channel 33.

The flow cross sections in the mixing zone 17 are so dimensioned that the length of stay of the fuel is shorter than time of ignition lag and the entry velocity of the fuel/air mixture into the combustion zone 12 is so large at every operating point of the gas turbine that a backfiring of the flame into the mixing zone 17 is precluded. The webs 19, in addition to their assist in the formation of a uniform mixture from fuel vapor and air, additionally have the task to stabilize as flame holder the combustion.

A portion of the air entering into the flame tube 11 by way of the secondary air openings 47 flows back into the combustion zone 12 and produces thereby an additionally stabilizing recirculation flow. The remaining portion of the air flows into the secondary zone 13 of the flame tube 11 and decreases thereat the temperature so far that no nitrogen oxides can result any longer whereas the decrease of carbon monoxides still continues in the presence of hydroxyl radicals. The corresponding flow conditions are schematically indicated in the drawing by dash lines.

In order to keep the combustion temperature within the desired limits over the entire driving range of the gas turbine, the ratio of the fuel/air mixture can be influenced during the operation. For that purpose, the quantity of the air flowing directly into the mixing zone 17 is changed by rotation of the throttle slide member 43. It is possible in this manner to achieve an optimum combustion for each operating point of the gas turbine, especially also in the partial load range.

Figure 3:
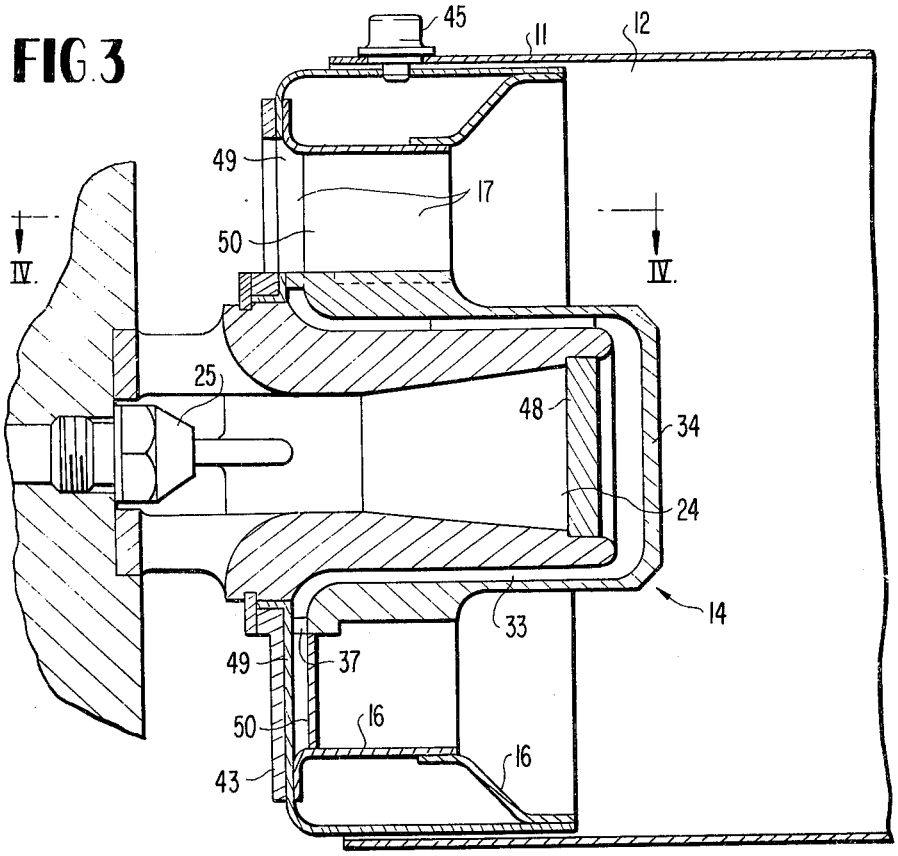
FIG. 3 is a partial longitudinal cross-sectional view through a modified embodiment of a combustion chamber in accordance with the present invention.

The combustion chamber illustrated in FIG. 3 includes an evaporator 14, in the channel 24 of which a disk-shaped insert 48 of highly porous material is arranged within the area of the bottom 34. The insert 48 serves the purpose to atomize at first the injected fuel prior to the evaporation. The evaporation is accelerated thereby and the formation of a uniform gas mixture is favored.

Figure 4:
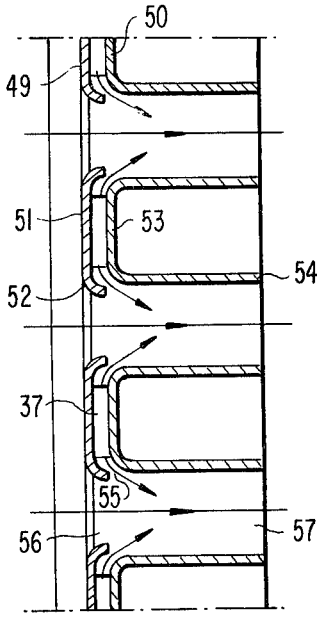
FIG. 4 is a development of a cylindrical cross section taken along line IV—IV of FIG. 3.

The radial webs 49 and 50 secured in the first and second plane of the mixing zone 17 of this embodiment are constructed as U-shaped profiles, as can be seen from FIG. 4. The webs 49 have a wide end surface 51 and short legs 52 whereas the webs 50 have a somewhat narrower end surface 53 and long legs 54. One web 50 each is so arranged downstream of each web 49 in the main flow direction of the combustion air that one gap 55 each results between the corresponding legs 52 and 54 of the two webs 49 and 50. In addition thereto, the short rounded-off legs 52 of the webs 49 leave free therebetween nozzle-shaped inlet openings 56 which pass over respectively into a mixing channel 57 formed by the long legs 54 of two adjacent webs 50. One of the openings 37 each, which discharge radially from the annular channel 33 of the evaporator, terminates between the end surfaces 51 and 53 of the webs 49 and 50. The openings 37 are in communication with the mixing channels 57 by way of the gaps 55.

Figure 2:
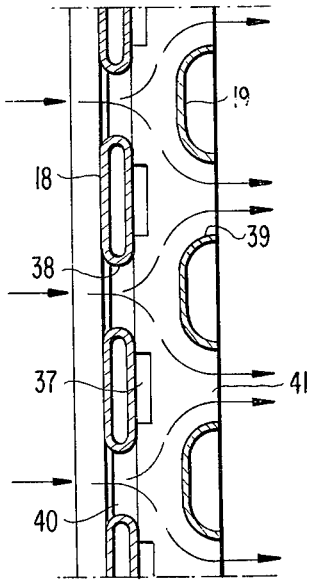
FIG. 2 is a development of cylindrical cross section taken along line II—II of FIG. 1.

In the operation of the gas turbine, air flows through the inlet openings 56 into the mixing channels 57 and the mixture of fuel vapor and air coming from the evaporator 14 flows into the mixing channels 57 through the gaps 55. The inlet openings 56 together with the gaps 55 thereby form ejectors which effect a good mixing of the two gas streams in the mixing channels 57 so that a uniform mixture flows into the combustion zone. The webs 50, as the webs 19 in the embodiment according to FIGS. 1 and 2, have thereby additionally the task to stabilize as flame holder the combustion.

Figure 5:
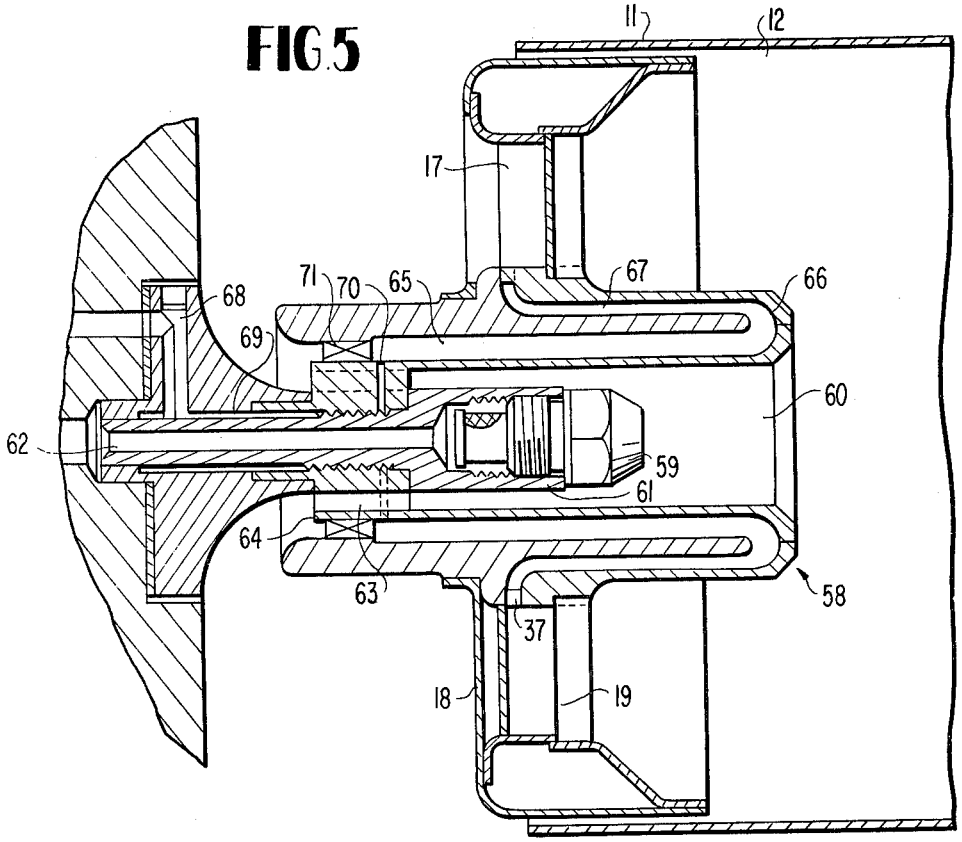
FIG. 5 is a longitudinal cross-sectional view through a combustion chamber with an ignition nozzle in accordance with the present invention.

FIG. 5 illustrates a combustion chamber with an evaporator generally designated by reference numeral 58, in which is arranged an ignition nozzle 59 through which ignition fuel is injected into the combustion zone 12 of the flame tube 11 during the starting of the gas turbine. For that purpose, the evaporator 58 includes a coaxial channel 60, into which projects the ignition nozzle 59 with a radial spacing. A tube or pipe 62 provided with a mounting portion 61 for the ignition nozzle 59 serves the purpose of supply of the ignition fuel. Openings 63 at the one end 64 of the channel 60 serve the supply of a portion of the air required for the combustion of the ignition fuel. This air additionally serves the purpose to cool the ignition nozzle 59 and to prevent the deposition of coke. The channel 60 of the evaporator 58 is coaxially surrounded by an inner annular channel 65 which leads to an axially symmetrical deflection surface 66, which is adjoined by an outer annular channel 67 coaxially to the axis of the evaporator 58. The outer annular channel 67 is connected with the mixing zone 17 of the flame tube 11 by way of radial openings 37. Radial webs 18 and 19 are arranged in two planes within the mixing zone 17 in the same manner as in the embodiment according to FIGS. 1 and 2.

A channel 68 and an annular channel 69 adjoining the channel 68 serve the purpose of feed of the main fuel to the evaporator 58. The annular channel 69 is connected with the inner annular channel 65 by way of radial capillary bores 70. Webs 71 which are positioned inclined to the axis of the evaporator are arranged in the inner annular channel 65 within the area of the air inlet, whereby the capillary bores 70 terminate in the inner annular channel 65 downstream of the webs 71. A swirl is imparted by the inclined webs 71 to the air flowing into the inner annular channel 65. The velocity of the air which is increased thereby in the swirl or vortex direction leads to a more rapid and more thorough mixing with the fuel. The capillary bores 70 also contribute thereto, out of which the fuel is discharged in a fine jet. Additionally, the rate of evaporation of the fuel is increased by the swirl or vortex produced by the webs 71 in cooperation with the deflection surface 66 so that an essentially homogeneous mixture of fuel vapor and air flows out of the outer annular channel 67 through the radial openings 37 into the mixing zone 17. The fuel/air mixture is uniformly mixed thereat with the air which flows in directly under the favorable interaction of the webs 18 and 19 and is fed to the combustion zone 12.

Figure 6:
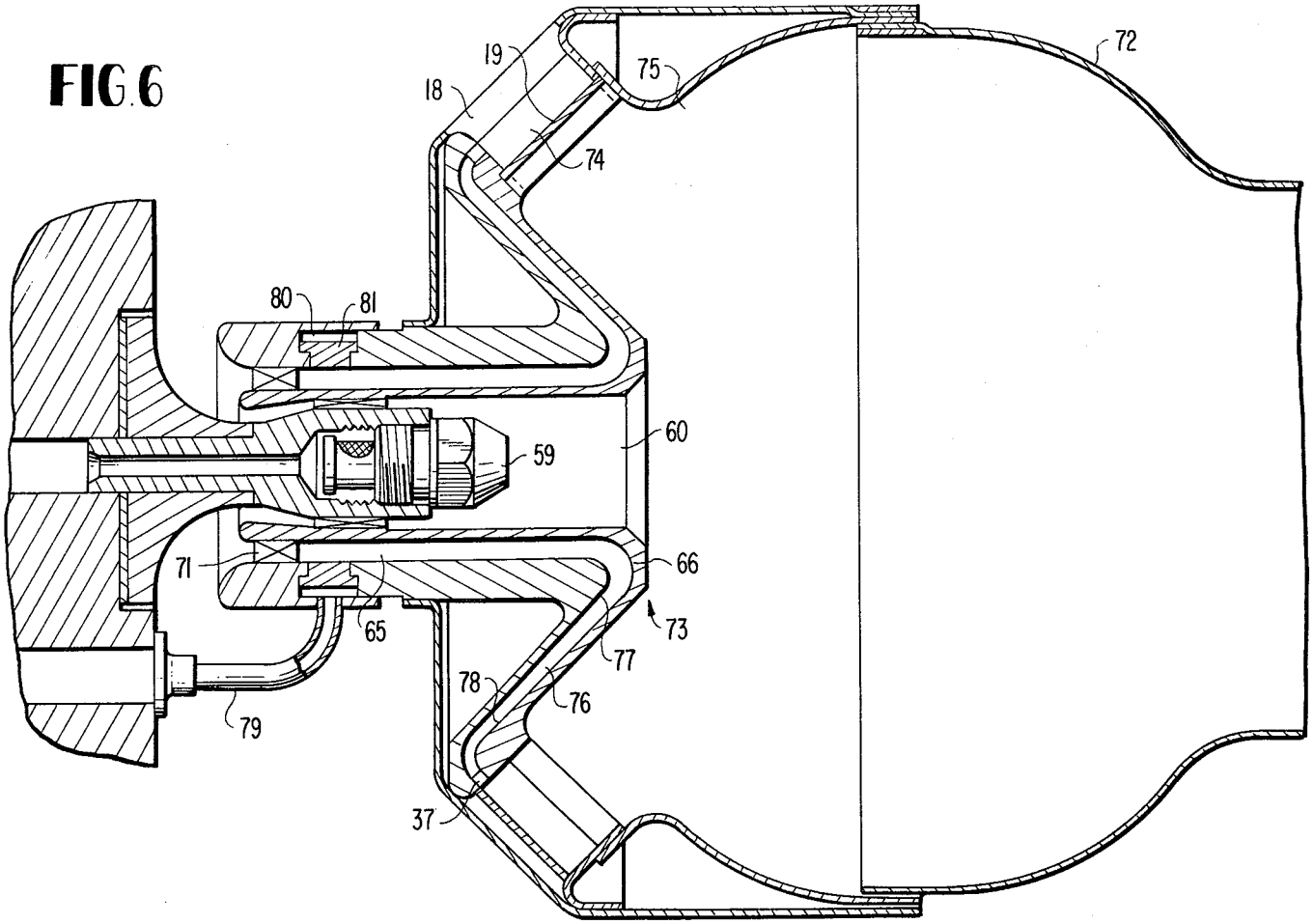
FIG. 6 is a longitudinal cross-sectional view through a further combustion chamber with an ignition nozzle in accordance with the present invention.

The combustion chamber illustrated in FIG. 6 which includes a flame tube 72, an evaporator generally designated by reference numeral 73 and an ignition nozzle 59 arranged therein is constructed in a manner similar to the combustion chamber illustrated in FIG. 5. It differs from the latter essentially in that the annular space forming the mixing zone 74 terminates funnel-shaped in the combustion zone 75. Correspondingly, also the radial webs 18 and 19 are inclined obliquely inwardly. The outer annular channel 76 leading to the mixing zone 74 tapers outwardly, i.e., becomes narrower in the outward direction. Its walls 77 and 78 are disposed on conical surfaces. Thus, a wide freedom is left to the configuration and design of the adjoining combustion zone 75.

The main fuel is fed to the evaporator 53 through a pipe 79 which terminates in an annular groove 80. A ring 81 of highly porous material is installed into the annular groove 80 which serves the purpose to atomize the fuel leaving the inner annular channel 65. As a result thereof, the mixing of the fuel with the air is accelerated and the complete evaporation thereof is facilitated. Sintered metals or sintered ceramic materials of conventional type may be used as material for the ring 81 as also for the insert 48 illustrated in FIG. 3.

The combustion chamber according to the present invention can be used with advantage not only in connection with gas turbines but quite generally, for example, also in connection with oil heating systems.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A combustion chamber, comprising a flame tube means forming a combustion zone, an evaporator means projecting into said combustion zone, said evaporator means being provided with a first evaporator channel means to which air and fuel are separately fed, and including deflection surface means arranged at an end of said first evaporator channel means, said deflection surface means being operable to deflect the fuel/air mixture to all sides in a direction generally opposite the main flow direction prevailing in said first evaporator channel means, characterized by an annular channel partly surrounding said first evaporator channel means, said annular channel being in communication with said first evaporator channel means in an immediate vicinity of the deflection surface means, a mixing zone located upstream of the combustion zone, as viewed in a main flow direction, said annular channel terminating in discharge aperture means for providing an essentially outwardly directed discharge from said annular channel into the mixing zone, said discharge aperture means extending radially outwardly at approximately a right angle to a longitudinal axis of the annular channel, said mixing zone being formed by an annular space between an outer wall of the evaporator means and an intermediate wall of the flame tube means and being traversed by air, and radially extending web means arranged in said annular space within a first and a second plane, the discharge aperture means of the annular channel terminating substantially between said web means.

2. A combustion chamber according to claim 1, characterized in that the deflection surface means is substantially axially symmetrical to the evaporator axis while said first evaporator channel means is substantially coaxial to the evaporator means.

3. A combustion chamber according to claim 2, characterized in that the discharge of said annular channel by way of said aperture means is generally radially outwardly directed approximately at a right angle.

4. A combustion chamber according to claim 3, characterized in that the mixing zone terminates funnel-shaped in the combustion zone so that walls delimiting the mixing zones and an outer annular channel of the annular channel are located essentially on cone surfaces.

5. A combustion chamber, comprising a flame tube means forming a combustion zone, an evaporator pipe means projecting into said combustion zone and provided with a first evaporator channel means to which air and fuel are separately fed, and including deflection surface means arranged at the end of said channel means, said deflection surface means being operable to deflect the fuel/air mixture in a direction generally opposite the main flow direction prevailing in said first evaporator channel means, characterized in that an annular channel means partly surrounds said first evaporator channel means, said annular channel means being in communication with a mixing zone located upstream of the combustion zone, as viewed in a main flow direction, by way of discharge aperture means extending generally radially outwardly approximately at a right angle so as to provide an essentially outwardly directed discharge, said mixing zone being formed by an annular space between a wall of the evaporator means and a wall of the flame tube means and being traversed by air, and radially extending web means arranged in said annular space within a first and a second plane, the discharge aperture means of the annular channel means terminating substantially between said web means, said deflection surface means deflects the air/fuel mixture substantially on all sides and is substantially axially symmetrical to the evaporator axis with said first evaporator channel means being substantially coaxial to the evaporator means, the mixing zone terminates funnel-shaped in the combustion zone so that walls delimiting the mixing zones and an outer annular channel of the annular channel means are located essentially on cone surfaces, and in that a throttling slide member is arranged directly ahead of the web means arranged in the first plane of the mixing zone.

6. A combustion chamber according to claim 5, characterized in that the web means arranged in the annular space are rounded off at their sides such that the webs disposed in a respective plane form therebetween nozzle-shaped openings.

7. A combustion chamber according to claim 6, characterized in that the web means arranged in the second plane are offset with respect to the web means arranged in the first plane and in that a discharge aperture means of the annular channel means terminates downstream of each web means arranged in the first plane.

8. A combustion chamber comprising a flame tube means forming a combustion zone, an evaporator means projecting into said combustion zone, said evaporator means being provided with a first evaporator channel means to which air and fuel are separately fed, and including deflection surface means arranged at the end of said first evaporator channel means and operable to deflect the fuel/air mixture in a direction generally opposite to the main flow direction prevailing in said first evaporator channel means, characterized in that an annular channel means partly surrounds said first evaporator channel means, said annular channel means being in communication with a mixing zone located upstream of the combustion zone, as viewed in a main flow direction, by way of discharge aperture means for providing an essentially outwardly directed discharge, said mixing zone being formed by an annular space between a wall of the evaporator means and a wall of the flame tube means and being traversed by air, and radially extending web means arranged in said annular space within a first and a second plane, the discharge aperture means of the annular channel means terminating substantially between said web means, and in that a throttling slide member is arranged directly ahead of the web means arranged in the first plane of the mixing zone.

9. A combustion chamber comprising a flame tube means forming a combustion zone, an evaporator means projecting into said combustion zone and provided with a first evaporator channel means to which air and fuel are separately fed, and including deflection surface means arranged at the end of said first evaporator channel means, said deflection surface means being operable to deflect the fuel/air mixture in a direction generally opposite the main flow direction prevailing in said first evaporator channel means, characterized in that an annular channel means partly surrounds said first evaporator channel means, said annular channel means being in communication with a mixing zone located upstream of the combustion zone, as viewed in a main flow direction, by way of discharge aperture means for providing an essentially outwardly directed discharge, said mixing zone being formed by an annular space between a wall of the evaporator means and a wall of the flame tube means and being traversed by air, and web means arranged in said annular space within a first and a second plane, the web means arranged in the annular space are rounded off at their sides such that the webs disposed in a respective plane form therebetween nozzle-shaped openings, and in that the discharge aperture means of the annular channel means terminates substantially between said web means.

10. A combustion chamber according to claim 9, characterized in that the web means arranged in the second plane are offset with respect to the web means arranged in the first plane and in that a discharge aperture means of the annular channel means terminates downstream of each web means arranged in the first plane.

11. A combustion chamber according to claim 9, characterized in that one web means arranged in the second plane is located downstream of a respective web means arranged in the first plane, and in that a discharge aperture means bordering two cooperating web means of the first and second plane terminates between said two web means.

12. A combustion chamber according to claim 1, characterized in that the evaporator means includes an evaporator body and evaporator pot, and in that the annular channel is formed by an outer wall of the evaporator body and the evaporator pot substantially coaxially surrounding the evaporator body, said evaporator pot including an essentially flat bottom having drawn up edges, said edges serving as said deflection surface means.

13. A combustion chamber comprising a flame tube means forming a combustion zone, an evaporator pipe means projecting into said combustion zone and provided with a first evaporator channel means to which air and fuel are separately fed, and including deflection surface means arranged at an end of said first evaporator channel means, said deflection surface means being operable to deflect the fuel/air mixture in a direction generally opposite the main flow direction prevailing in said first evaporator channel means, characterized in that the evaporator means includes an evaporator body and an evaporator pot, an annular channel means partly surrounds said first evaporator channel means, said annular channel means being in communication with a mixing zone located upstream of the combustion zone, as viewed in a main flow direction, by way of discharge aperture means for providing an essentially outwardly directed discharge, the annular channel means is formed by an outer wall of the evaporator body and the evaporator pot substantially coaxially surrounds the evaporator body, said evaporator pot includes an essentially flat bottom having drawn up edges, said edges serving as the deflection surface means, said mixing zone being formed by an annular space between the outer walls of the evaporator body and a wall of the flame tube means and being traversed by air, web means arranged in said annular space within a first and a second plane, the discharge aperture means of the annular channel means terminating substantially between said web means, and in that an outer surface of the evaporator pot is secured at webs arranged in the annular channel means and at web means arranged in the second plane of the mixing zone.

14. A combustion chamber according to claim 13, characterized in that the first channel means of the evaporator means has the configuration of a Venturi nozzle.

15. A combustion chamber according to claim 14, characterized in that an insert of highly porous material is arranged in the first channel means.

16. A combustion chamber comprising an ignition nozzle means, a flame tube means forming a combustion zone, an evaporator means projecting into said combustion zone and provided with a first evaporator channel means to which air and fuel are separately fed, and including deflection surface means arranged at an end of said first evaporator channel means, said deflection surface means being operable to deflect the fuel/air mixture in a direction generally opposite the main flow direction prevailing in said first evaporator channel means, characterized in that annular channel means partly surround said first evaporator channel means, said annular channel means being in communication with a mixing zone located upstream of the combustion zone, as viewed in a main flow direction, by way of discharge aperture means for providing an essentially outwardly directed discharge, said mixing zone being formed by an annular space between a wall of the evaporator means and a wall of the flame tube means and being traversed by air, and web means arranged in said annular space within a first and a second plane, the discharge aperture means of the annular channel means terminating substantially between said web means, and in that the evaporator means includes a coaxial channel means to which air is supplied and in which the ignition nozzle means is arranged with a radial spacing relative to inner walls of the coaxial channel means, and in that said coaxial channel means is substantially coaxially surrounded by an inner annular channel forming part of said first evaporator channel means to which air and fuel are separately fed and which leads to the deflection surface means which is adjoined substantially coaxially by said annular channel means forming an outer annular channel which is in communication with the mixing zone.

17. A combustion chamber according to claim 16, characterized in that further web means constructed as swirl surfaces are arranged in the inner annular channel within the area of the air inlet, while fuel is being fed into said inner annular channel downstream of said further web means.

18. A combustion chamber according to claim 17, characterized in that the fuel is fed to the inner surface by way of capillary bores.

19. A combustion chamber according to claim 17, characterized in that the fuel is fed to the inner annular channel by way of an annular groove surrounding the same, into which is inserted a ring of highly porous material.

20. A combustion chamber according to claim 16, characterized in that the web means arranged in the annular space are rounded off at their sides such that the webs disposed in a respective plane form therebetween nozzle-shaped openings.

21. A combustion chamber according to claim 20, characterized in that the web means arranged in the second plane are offset with respect to the web means arranged in the first plane and in that a discharge aperture means of the annular channel means terminates downstream of each web means arranged in the first plane.

22. A combustion chamber according to claim 20, characterized in that one web means arranged in the second plane is located downstream of a respective web means arranged in the first plane, and in that a discharge aperture means bordering two cooperating web means of the first and second plane terminates between said two web means.

23. A combustion chamber according to claim 16, characterized in that the mixing zone terminates funnel-shaped in the combustion zone so that the walls delimiting the mixing zones and the outer annular channel of the annular channel means are located essentially on cone surfaces.

24. A combustion chamber according to claim 1, characterized in that the first evaporator channel means has a configuration of a Venturi nozzle.

25. A combustion chamber according to claim 1, characterized in that an insert of a highly porous material is arranged in the first evaporator channel means.

26. A combustion chamber according to claim 3, characterized by secondary air openings provided in the flame tube means inclined obliquely inwardly to the combustion zone opposite the main flow direction.

27. A combustion chamber according to claim 26, characterized in that the evaporator means, the web means and the wall of a flame tube means defining in part the mixing zone form a structural unit which is retained in the flame tube means by way of connecting means distributed over the circumference under the formation of an annular gap.

28. A combustion chamber according to claim 27, characterized in that the evaporator means includes an evaporator body and evaporator pot, and in that the annular channel is formed by an outer wall of the evaporator body and the evaporator pot substantially coaxially surrounding the evaporator body, said evaporator pot including an essentially flat bottom having drawn up edges, said edges serving as said deflection surface means.

29. A combustion chamber according to claim 1, characterized in that the evaporator means, the web means and the wall of a flame tube means defining in part the mixing zone form a structural unit which is retained in the flame tube means by way of connecting means distributed over the circumference under a formation of an annular gap.

30. A combustion chamber according to claim 1, characterized by secondary air openings provided in the flame tube means inclined obliquely inwardly to the combustion zone opposite the main flow direction.

* * * * *